US009260894B2

(12) United States Patent
Waskie

(10) Patent No.: US 9,260,894 B2
(45) Date of Patent: Feb. 16, 2016

(54) PROP ROD END PIECE

(71) Applicant: GM GLOBAL TECHNOLOGY OPERATIONS LLC, Detroit, MI (US)

(72) Inventor: David Waskie, Mountain Top, PA (US)

(73) Assignee: GM Global Technology Operations LLC, Detroit, MI (US)

( * ) Notice: Subject to any disclaimer, the term of this patent is extended or adjusted under 35 U.S.C. 154(b) by 168 days.

(21) Appl. No.: 13/870,033

(22) Filed: Apr. 25, 2013

(65) Prior Publication Data

US 2014/0319881 A1 Oct. 30, 2014

(51) Int. Cl.

| | |
|---|---|
| ***E05C 17/24*** | (2006.01) |
| ***E05C 17/04*** | (2006.01) |
| ***E05C 17/12*** | (2006.01) |

(52) U.S. Cl.

CPC ..... *E05C 17/24* (2013.01); *E05C 17/04* (2013.01); *E05C 17/12* (2013.01)

(58) Field of Classification Search

CPC ..... B62D 25/12; E05C 17/24; E05F 5/022
USPC ..... 296/193.11, 187.09; 180/69.2
See application file for complete search history.

(56) References Cited

U.S. PATENT DOCUMENTS

| | | | | |
|---|---|---|---|---|
| 2,811,866 | A * | 11/1957 | Buchanan | 74/503 |
| 4,317,287 | A * | 3/1982 | Sausele | 33/24.1 |
| 4,991,675 | A * | 2/1991 | Tosconi et al. | 180/69.21 |
| 5,689,916 | A * | 11/1997 | Jensen et al. | 49/252 |
| 7,219,780 | B2 * | 5/2007 | Thurmann et al. | 188/322.17 |
| 7,909,125 | B1 * | 3/2011 | Keen | 180/69.21 |

FOREIGN PATENT DOCUMENTS

| | | | |
|---|---|---|---|
| CN | 201357870 | Y | 12/2009 |
| CN | 201721517 | U | 1/2011 |
| CN | 202175109 | U | 3/2012 |
| CN | 202574392 | U | 12/2012 |
| CN | 202624396 | U | 12/2012 |
| CN | 202624399 | U | 12/2012 |
| JP | 2008230329 | A | 10/2008 |

* cited by examiner

*Primary Examiner* — Glenn Dayoan
*Assistant Examiner* — Sunsurraye Westbrook
(74) *Attorney, Agent, or Firm* — Quinn Law Group, PLLC

(57) ABSTRACT

An end piece for connecting a prop rod to a seat includes a body having a first end and a second end opposite the first end. A flange is formed on the second end of the body, and is configured to abut the seat. The end piece may have a hole defined in the first end of the body, such that the prop rod inserted into the hole, or the end piece may connect to the prop rod with other structure. The end piece has a top key formed on the flange. The top key extends away from the body and helps hold the end piece to the seat.

7 Claims, 3 Drawing Sheets

PROP ROD END PIECE

TECHNICAL FIELD

This disclosure relates to mechanisms for propping vehicle hoods or hood panels open.

BACKGROUND

Vehicles may use hoods, deck lids, or bonnets to cover the compartments, such as the engine compartment. Particularly on forward-facing engine compartments, the hood may need to be held open to provide access to the engine compartment for service or diagnostics.

SUMMARY

An end piece for connecting a prop rod to a seat is provided. The end piece includes a body having a first end and a second end opposite the first end. A flange is formed on the second end of the body. The flange is configured to abut the seat.

The end piece may have a hole defined in the first end of the body, such that the prop rod is configured to be inserted into the hole. However, the end piece may connect to the prop rod with other structure.

The end piece has a top key formed on the flange. The top key extends away from the body and helps hold the end piece to the seat. In some configurations, the body, the flange, and the top key may be formed unitarily as one piece.

The above features and advantages, and other features and advantages, of the present invention are readily apparent from the following detailed description of some of the best modes and other embodiments for carrying out the invention, which is defined solely by the appended claims, when taken in connection with the accompanying drawings.

DETAILED DESCRIPTION

Figure 1:
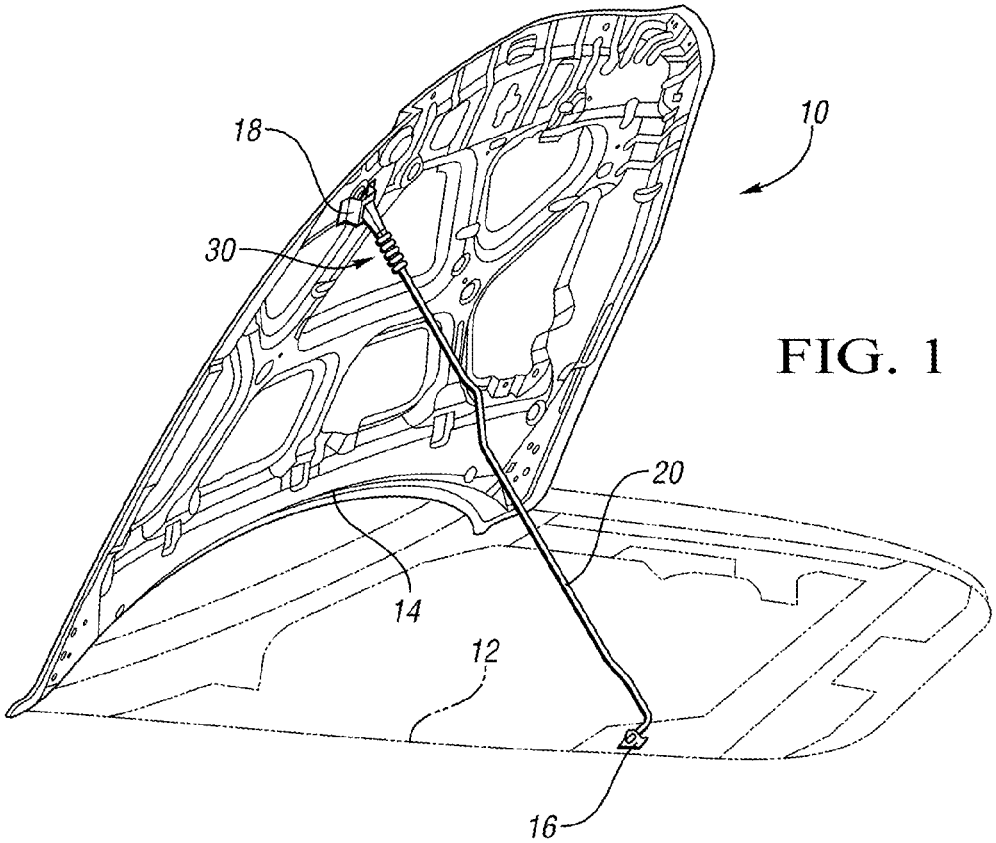
FIG. 1 is a schematic isometric view of a prop rod mechanism for a vehicle hood.

Referring to the drawings, like reference numbers correspond to like or similar components wherever possible throughout the several figures. FIG. 1 shows a prop mechanism 10 for a vehicle (not separately numbered) having a vehicle body 12 and a hood panel 14. The prop mechanism 10 allows the hood panel 14 to be maintained open (as shown) and above the vehicle body 12.

While the present invention may be described with respect to automotive or vehicular applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Any specific configurations shown in the figures are illustrative only and the specific configurations shown are not limiting of the claims or the description. All elements may be mixed and matched between figures. Unless otherwise necessary, the location of features relative to one another may be altered, particularly to better incorporate features into the surrounding environment.

The prop mechanism 10 includes a pivot 16 attached to the vehicle body 12 and a seat 18, which is shown formed on the hood panel 14. The seat 18 may be a separate component attached to the hood panel 14 or may be formed within a portion of the hood panel 14. In many configurations, the hood panel 14 will be formed from an inner panel and an outer panel (neither of which are separately numbered). Much of the structure coordinating with the prop mechanism 10 may be part of the inner panel, and the seat 18 may be formed, punched, or stamped therein instead of being formed as a separate component (as shown in the figures).

The prop mechanism 10 also includes a prop rod 20, which is configured to span between the vehicle body 12 and the hood panel 14. The prop rod 20 has a first end, which may be referred to as a pivot end 22. The pivot 16 rotatably attaches the pivot end 22 of the prop rod 20 to the vehicle body 12. The prop rod 20 has a second end, which may be referred to as a hood end 24, opposite the pivot end 22. Note that numerical designation of any component or portion of a component as first or second is illustrative and not intended to be limiting.

The pivot 16 allows the prop rod 20 to move between a stowed position, in which the hood end 24 of the prop rod 20 is proximal to the vehicle body 12, and an engaged position, in which the hood end 24 of the prop rod 20 is distal to the vehicle body 12 and proximal to the seat 18.

Alternatively, although not shown, the pivot 16 may be attached to the hood panel 14, such that the prop rod 20 spans from the hood panel 14 down to the vehicle body 12 when the hood panel 14 is opened. In such a configuration, a seat may be formed in the vehicle body 12.

Figure 2:
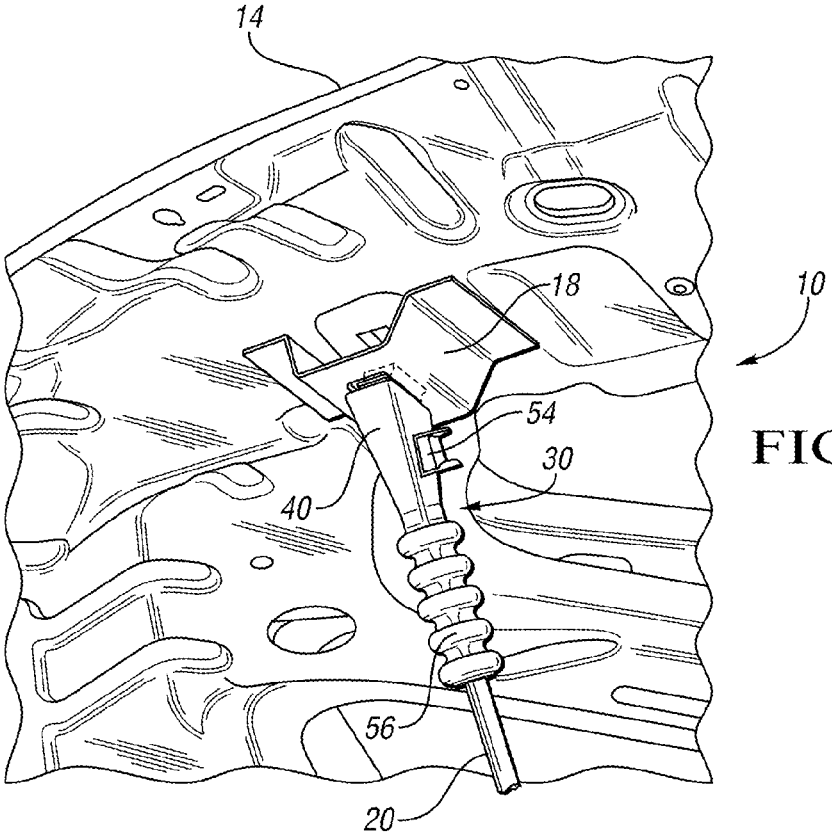
FIG. 2 is another schematic isometric view of the prop rod mechanism.
Figure 3:
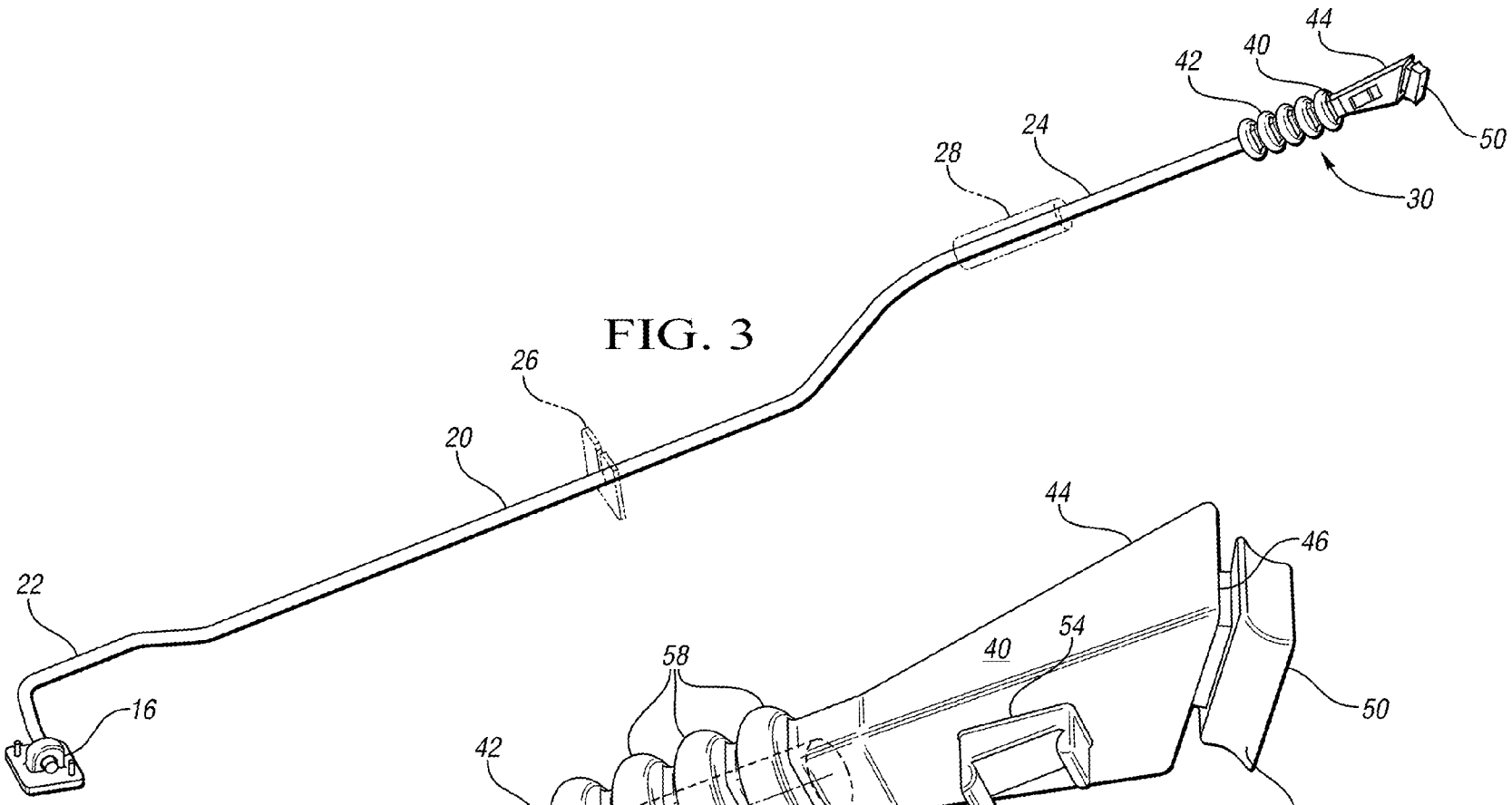
FIG. 3 is a schematic isometric view of the prop rod mechanism without the hood panel.

Referring also to FIG. 2 and to FIG. 3, in addition to FIG. 1, there are shown additional views of the prop mechanism 10. FIG. 2 shows a closer view of the prop mechanism 10 interacting with the hood panel 14. FIG. 3 shows the prop mechanism 10 laid down into the stowed position, which would allow the hood panel 14 (not shown in FIG. 3) to close.

As shown in FIG. 3, some configurations of the prop mechanism 10 may include a body-side clip 26 and a detachable isolator 28, both of which are illustrated with dashed lines. The body-side clip 26 may be fixedly attached to the vehicle body 12 and helps retain the prop rod 20 to the vehicle body 12. The detachable isolator 28 may be formed from foam or rubber.

The prop mechanism 10 includes an end piece 30 attached to the hood end 24 of the prop rod 20. The end piece 30 is formed from a body 40 having a first end, which may be referred to as a rod end 42, and a second end, which may be referred to as a seat end 44, and is opposite the rod end 42. If the prop mechanism 10 were reversed, such that pivot 16 is on the hood panel 14 and the prop rod 20 spans downward from the hood panel 14 to the vehicle body 12, the seat 18 may be formed in the vehicle body 12 and the end piece 30 may interact with the vehicle body 12.

Figure 4:
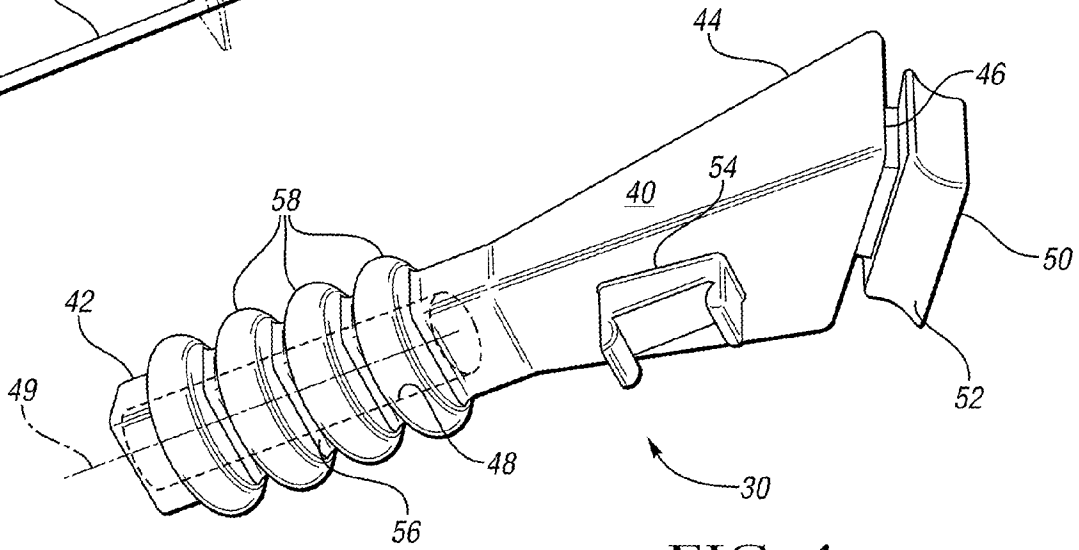
FIG. 4 is a schematic isometric view of an end piece of the prop rod mechanism.

Referring also to FIG. 4, in addition to FIGS. 1-3, there is shown a closer view of the end piece 30. The end piece 30 has a flange 46 on the seat end 44 of the body 40. The flange 46 is configured to abut the seat 18. A hole 48 is defined in the rod end 42 of the body 40. The prop rod 20 is configured to be inserted into the hole 48. Therefore, the flange 46 transfers loads from the hood panel 14 to the end piece 30 and the prop rod 20.

Alternatively, although not shown, the rod end 42 of the end piece 30 may mate to the prop rod 20 without the hole 48 being formed in the body 40. For example, a boss may extend from the rod end 42 and insert into a hole formed within the prop rod 20, or a fastener may attach the rod end 42 of the end piece 30 to the prop rod 20.

As shown in the figures, the flange 46 of the end piece 30 is angled relative to an axis 49 of the hole 48. The angled flange 46 may be used where the seat 18 is substantially parallel to the hood panel 14. In one alternative configuration, the seat 18 may be angled relative to the hood panel 14 and the flange 46 may be substantially perpendicular to the axis 49 and the body 40.

The end piece 30 has a top key 50 formed on the flange 46 and extending away from the body 40. The top key 50 extends substantially perpendicularly to the flange 46. The top key 50 is configured to mate with the seat 18 when the prop rod 20 is moved into the engaged position. The seat 18 may include a hole, recession, or indentation (not separately numbered) that substantially matches the shape of the top key 50. Therefore, the top key 50 and the seat 18 cooperate to keep the prop rod in the engaged position and the hood panel 14 open.

In the end piece 30 shown in the figures, the body 40, the flange 46, and the top key 50 are formed unitarily as one piece. As used herein, and as recognized by those having ordinary skill in the art, one-piece elements lack seams; are formed together without subsequent assembly or attachment; and do not require fasteners, adhesives, or weld joints. Additionally, one-piece elements are generally formed through a one-shot process, such as by casting or injection molding, or are formed by machining the component shape from a solid piece of material. Therefore, the body 40, the flange 46, and the top key 50 may be considered a single component, along with any other elements formed as one-piece therewith.

The end piece 30 also includes an overhanging portion or a cantilevered boss 52 extending from the top key 50. The cantilevered boss 52 is generally parallel to, and overhangs, the flange 46, such that the cantilevered boss 52 of the top key 50 at least partially inserts into the seat 18. The cantilevered boss 52 forms a slot or area into which a portion of the seat 18 may slide.

In the configuration shown, the cantilevered boss 52 extends downward relative to the hood panel 14. The cantilevered boss 52 may provide better retention of the end piece 30 to the seat 18 and prevent the end piece 30 and the prop rod 20 from becoming unintentionally disengaged from the hood panel 14.

In the prop mechanism 10, the end piece 30 also includes a retainer clip 54 and an isolator 56. The retainer clip 54 is formed on the body 40 of the end piece 30 and extends away from the body 40, and is configured to attach the prop rod 20 to the vehicle body 12 in the stowed position. The retainer clip 54 is formed unitarily as one piece with the body 40. The retainer clip 54 may be designed to grasp objects of different shape and size on the vehicle body 12 or other fixed structure. The position of the retainer clip 54 shown is illustrative only. The retainer clip 54 may move to different areas of the end piece 30 based upon, for example, the location of the pivot 16 and to the structure, or structures, to which the retainer clip 54 attaches.

The isolator 56 is formed on the rod end 42 of the body 40 of the end piece 30 and extends radially away from the axis 49 of the hole 48. The isolator 56 may be generally cylindrical and provides heat isolation from heat carried through the prop rod 20 from the engine compartment. The isolator 56 is also formed unitarily as one piece with the body 40. Because the retainer clip 54 and the isolator 56 are formed as one piece with the end piece 30, the prop mechanism 10 may function without the body-side clip 26 and the detachable isolator 28.

On the end piece 30 shown, the body 40 is tapered from the flange 46 to the isolator 56. Therefore, the body 40 is smaller at the isolator 56. The taper may reduce the mass of the end piece 30 over non-tapered configurations.

Furthermore, the isolator 56 of the end piece 30 is formed from a plurality of ribs 58, each of which extends radially away from the axis 49 of the hole 48. The ribs 58 may improve heat dissipation and improve grip for a vehicle operator grabbing the prop mechanism 10. The number of ribs 58 may be varied, but many configurations will include between three to five ribs 58.

Figure 5A:
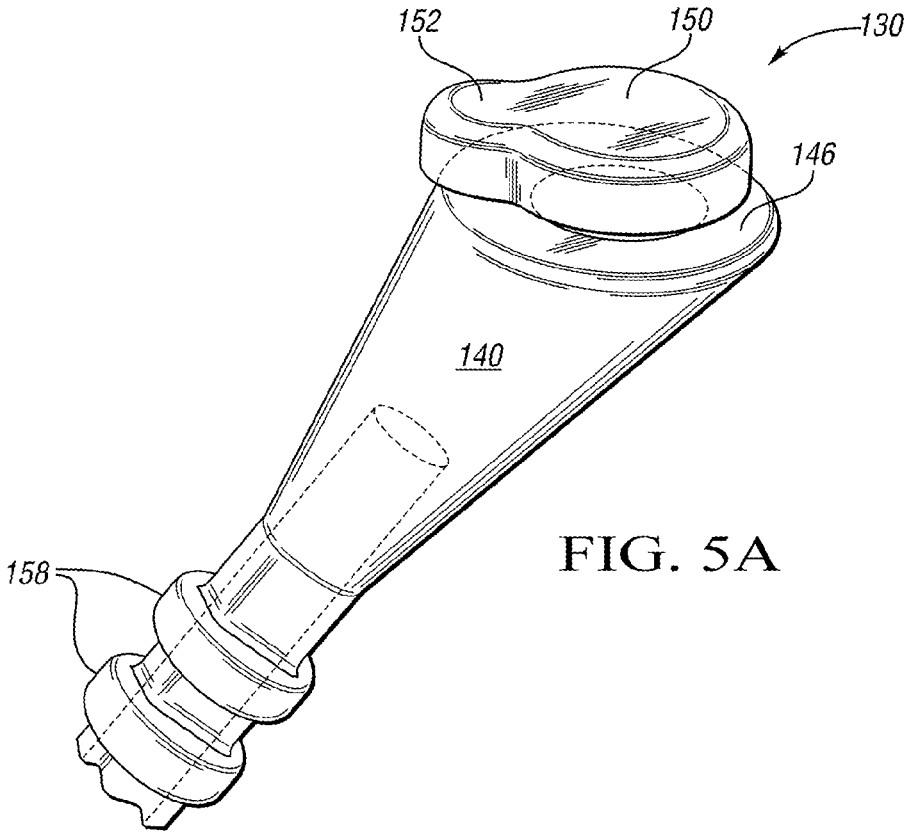
FIG. 5A is a schematic isometric view of an end piece for a prop rod mechanism.
Figure 5B:
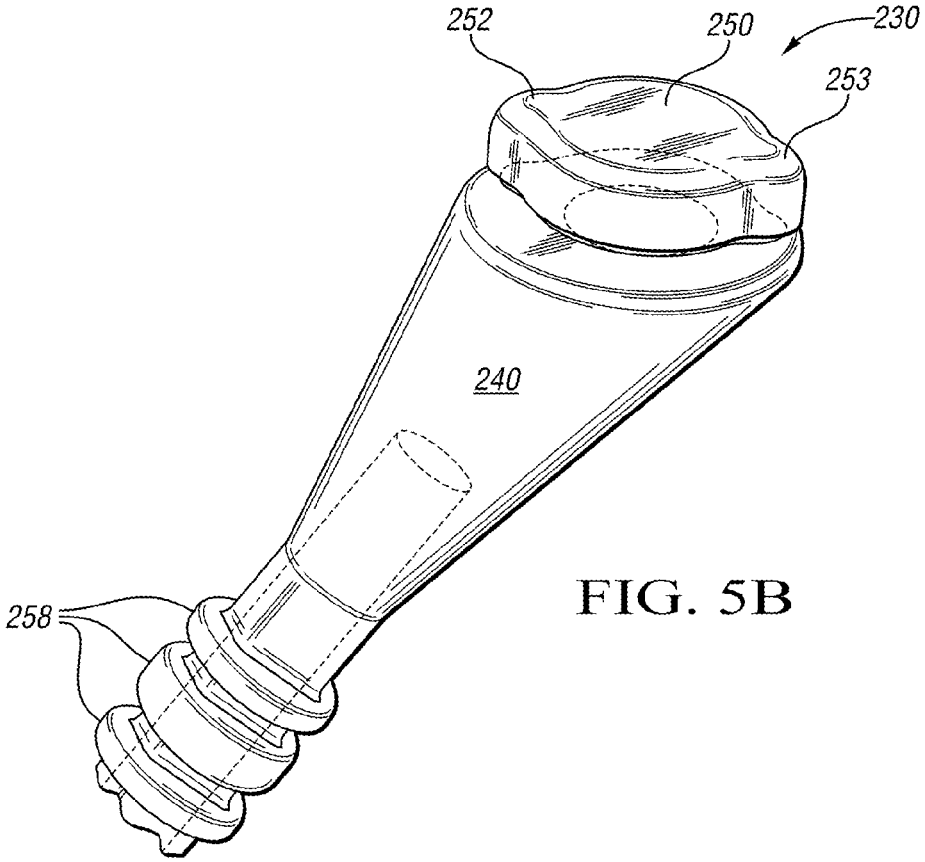
FIG. 5B is a schematic isometric view of another end piece for a prop rod mechanism.

Referring now to FIG. 5A and FIG. 5B, and with continued reference to FIGS. 1-4, there are shown variations of the prop mechanism 10. FIG. 5A shows a schematic isometric view of an end piece 130 for the prop mechanism 10, and FIG. 5B shows a schematic isometric view of an end piece 230 for the prop mechanism 10.

The end piece 130 includes many substantially identical features to the end piece 30 shown in FIGS. 1-4. However, a body 140 and a top key 150 of the end piece 130 are generally cylindrical, as contrasted with the generally rectangular body 40 and top key 50 of the end piece 30. Any hole or indentation formed in the seat 18 may be altered to match the general shape of the top key 150, or the seat 18 may remain unchanged from that shown in FIGS. 1 and 2.

The end piece 130 also includes a cantilevered boss 152 extending from the top key 150. The cantilevered boss 152 is also generally parallel to a flange 146 and overhangs a portion of the flange 146, which may help retain the end piece 130 to its respective seat (not shown). The end piece 130 includes an isolator with at least two ribs 158.

Similarly, the end piece 230 includes a body 240 and a top key 250 that are generally cylindrical. The end piece 230 includes a first cantilevered boss 252 extending away from the top key 250. However, the end piece 230 further includes a second cantilevered boss 253 substantially opposite the first cantilevered boss 252. The second cantilevered boss 253 may further help retain the end piece 230 to the seat 18 in order to keep the prop mechanism 10 holding the hood panel 14.

The end piece 230 includes an isolator with at least three ribs 258. On the end piece 230 shown, the ribs 258 are different sizes or widths.

The detailed description and the drawings or figures are supportive and descriptive of the invention, but the scope of the invention is defined solely by the claims. While some of the best modes and other embodiments for carrying out the claimed invention have been described in detail, various alternative designs, configurations, and embodiments exist for practicing the invention defined in the appended claims.

The invention claimed is:

1. A prop mechanism for a vehicle having a hood panel, comprising:

a prop rod having a first end and a second end opposite the first end;

a pivot configured to rotatably attach the first end of the prop rod to the vehicle, wherein the pivot allows the prop rod to move between a stowed position and an engaged position;

a seat on the hood panel; and an end piece attached to the second end of the prop rod, including:

a body having a first end and a second end opposite the first end, wherein the first end of the body mates with the second end of the prop rod;

a flange on the second end of the body, wherein the flange is configured to abut the seat; and a top key formed on the flange extending away from the body, wherein the top key is configured to mate with the seat when the prop rod is moved into the engaged position.

2. The prop mechanism of claim 1, further comprising:

a retainer clip formed on the body of the end piece and extending away from the body, wherein the retainer clip is formed unitarily as one piece with the body and is configured to attach the prop rod to the vehicle in the stowed position.

3. The prop mechanism of claim 2, further comprising:

a hole defined in the first end of the body, wherein the prop rod is configured to be inserted into the hole.

4. The prop mechanism of claim 3, further comprising:

an isolator formed on the first end of the body of the end piece and extending radially away from the axis of the hole, wherein the isolator is formed unitarily as one piece with the body.

5. The prop mechanism of claim 4, further comprising:

a cantilevered boss extending from the top key of the end piece and generally parallel to the flange, such that the top key traps a portion of the seat.

6. The prop mechanism of claim 5, wherein the isolator is formed from a plurality of ribs, each of which extends radially away from the axis of the hole.

7. The prop mechanism of claim 6, wherein the body, the flange, and the top key are formed unitarily as one piece.

* * * * *